United States Patent [19]

Steiner et al.

[11] Patent Number: 4,640,451

[45] Date of Patent: Feb. 3, 1987

[54] COMBINATION HOLE PUNCH AND STAPLER

[75] Inventors: Paul Steiner, Staad; Bruno Stocker, Berneck, both of Switzerland

[73] Assignee: Kollektivgesellschaft Eberhard, Steiner & Dr. Stocker, Kloten, Switzerland

[21] Appl. No.: 629,830

[22] PCT Filed: Nov. 7, 1982

[86] PCT No.: PCT/CH83/00121

§ 371 Date: Jun. 26, 1984

§ 102(e) Date: Jun. 26, 1984

[87] PCT Pub. No.: WO84/01739

PCT Pub. Date: May 10, 1984

[30] Foreign Application Priority Data

Nov. 8, 1982 [CH] Switzerland ..... 6461/82
May 31, 1983 [CH] Switzerland ..... 2982/83

[51] Int. Cl.[4] ..... B25C 5/02; B26F 1/36

[52] U.S. Cl. ..... 227/76; 227/120; 227/127; 402/1

[58] Field of Search ..... 227/76, 110, 120, 121, 227/127; 402/1

[56] References Cited

U.S. PATENT DOCUMENTS

| | | | |
|---|---|---|---|
| 223,252 | 1/1880 | Smyth | 227/113 |
| 1,810,528 | 6/1931 | Peterson | 227/113 |
| 2,343,932 | 3/1944 | Ruskin . | |
| 2,931,038 | 4/1950 | Wandel . | |
| 4,179,057 | 12/1979 | Becht et al. | 227/120 X |

FOREIGN PATENT DOCUMENTS

| | | | |
|---|---|---|---|
| 687908 | 2/1940 | Fed. Rep. of Germany . | |
| 0819542 | 11/1951 | Fed. Rep. of Germany | 227/127 |
| 808466 | 6/1953 | Fed. Rep. of Germany . | |
| 0964407 | 5/1957 | Fed. Rep. of Germany | 227/113 |
| 7420270 | 12/1974 | Fed. Rep. of Germany . | |
| 2619961 | 11/1977 | Fed. Rep. of Germany . | |
| 7832860 | 11/1978 | Fed. Rep. of Germany . | |
| 2940942 | 5/1980 | Fed. Rep. of Germany . | |
| 7804967 | 9/1979 | France | 227/127 |
| 0589349 | 3/1959 | Italy | 227/113 |
| 0068533 | 3/1951 | Netherlands | 227/113 |
| 0080571 | 8/1952 | Norway | 227/120 |

*Primary Examiner*—Howard N. Goldberg
*Assistant Examiner*—Taylor J. Ross
*Attorney, Agent, or Firm*—Werner W. Kleeman

[57] ABSTRACT

In an organizing device comprising a stapler and a hole punch, the magazine for the staples is exploitable substantially over its entire length, since the spring for feeding the staples is arranged transverse to the feed direction and is fastened outside of the magazine. Due to this space-saving arrangement of the spring the device can be built very narrow, so that it is quite possible to carry it in a briefcase or to fasten it within a thin ring binder.

A first rocking lever operates the hole punch and a second rocking lever operates the stapler. A latch or translatable driver arrangement selectively couples the first and second rocking levers for joint action of the hole punch and the stapler and disengages them for independent action.

20 Claims, 8 Drawing Figures

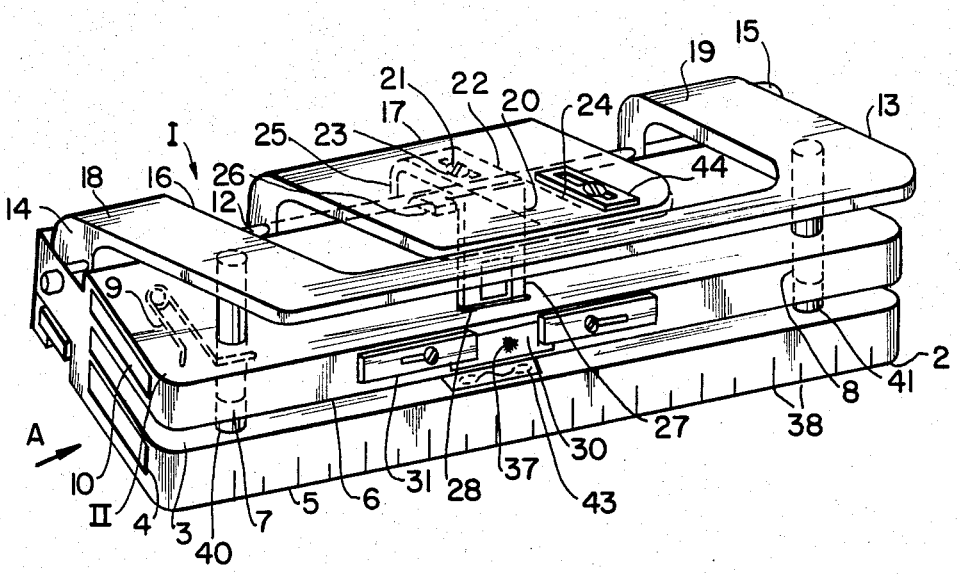
FIG. 1
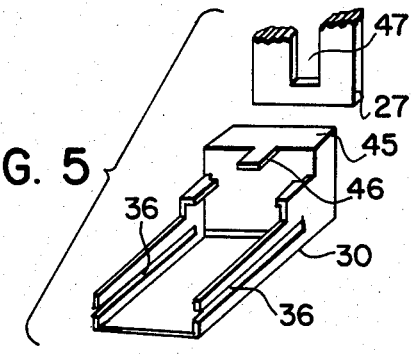
FIG. 5
FIG. 2
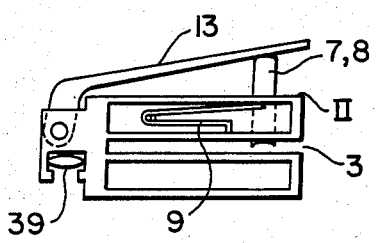
FIG. 3
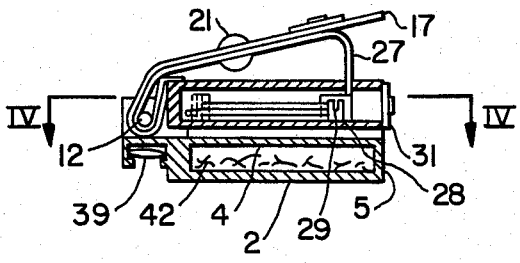
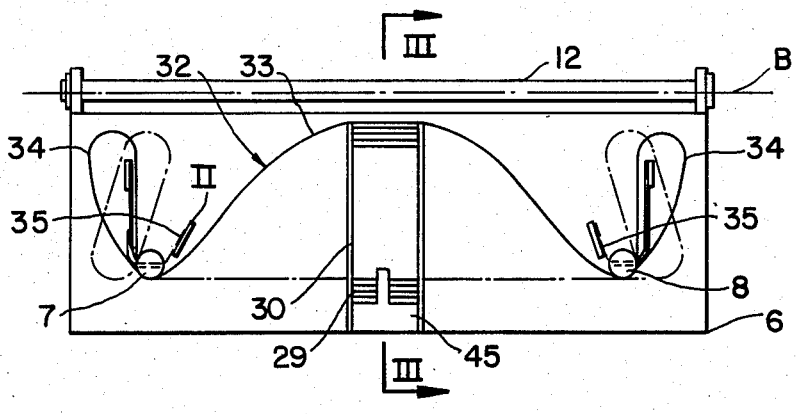
FIG. 4

COMBINATION HOLE PUNCH AND STAPLER

BACKGROUND OF THE INVENTION

The present invention broadly relates to office accessories and, more specifically, pertains to a new and improved construction of an organizing device comprising a stapler and a hole punch.

Generally speaking, the organizing device of the present invention is suitable for travel, office, school and the home and comprises a hole punch having a first rocking lever and at least two punches, a stapler integrated into the hole punch for stapling together documents being processed by means of an initially U-shaped staple of conventional design and having a magazine for accommodating staples and including stop means for the staples, spring means for pressing the staples against the stop means in the magazine, a flat plunger for inserting a staple bearing against the stop means into the documents being processed and a second rocking lever operatively connected with the flat plunger, and a base pivotably connected to the first and second rocking levers and having a forming anvil for closing the legs of the staple upon the rear or opposite side of the documents being processed and at least two bores defining female dies for the punches of the hole punch.

In addition to robustly built office staplers having a long cantilever, small staplers for home or private use are also known. These are usually built in the same manner as the professional devices. The conventional arrangement of the staple magazine and its associated spiral spring with a guide shoe for feeding the staples leads to a length and height of construction which hinders portability in a briefcase or in a jacket.

Both the known professional devices and the small staplers comprise a staple magazine which is pivotable toward the base. Both the insertion plunger and the staple therefore move through a circular arc in stapling. This has the consequence that, on the one hand, the insertion plunger does not advance the staple precisely in a plane and, on the other hand, that the staple does not impinge perpendicularly upon the base or anvil. In small staplers, which, for reasons of economy are not very stably built, this often leads to a jamming of the plunger and of the staple or to faulty staplings with bent staples.

Combinations of hole punches and staplers which can be operated individually or jointly are also known from the literature. The German Patent Publication No. 2,619,961 shows a combination consisting of a conventional hole punch into which a conventional stapler is inserted. When operating the stapler, holes are automatically punched; when operating the hole punch, on the other hand, the stapler remains out of operation. In addition to the disadvantages that the two functions, stapling and hole-punching, cannot be executed selectively, the mechanical components are designed such that they can only be manufactured for a large desk model, but not as a handy device for travel, household or school. This is because the unconditionally required forces upon the punches cannot be generated in a miniaturized version.

A further device for stapling and hole-punching is known from the German Petty Pat. No. 7,420,270 with which— given sufficient dexterity of the user—both functions can be executed individually or jointly. This device, due to its complicated construction, is very large and cannot be miniaturized. Furthermore, the inserted staple does not lie in line with the punches, which renders this device unusable for many purposes.

Also both patents mentioned in the aforementioned German Petty Pat. (German Pat. No. 687,908 and Austrian Pat. No. 165,605) display constructional extravagance and manipulatory problems which preclude an economical manufacture and application beyond the desk.

SUMMARY OF THE INVENTION

Therefore, with the foregoing in mind, it is a primary object to the present invention to provide an new and improved construction of an organization device which does not exhibit the aforementioned drawbacks and shortcomings of the prior art constructions.

Yet a further significant object of the present invention is to provide a new and improved construction of an organizing device of the previously mentioned type which both punches and staples and is of such small size that it can be accommodated in a slender ring binder (e.g. 4 cm wide), carried in a jacket or carried in a thin briefcase. Both functions, punching and stapling, are both individually and jointly executable. Furthermore, the device can also accommodate additional office utensils, e.g. a letter opener or a scale. A further object of the invention consists in providing a stapler which is of such small depth that it can be readily integrated into a hole punch.

A further object of the invention consists in constructing the staple magazine such that it can be filled with staples over essentially its entire length.

A further object of the invention is to construct the stapler such that fine staples which often jam in conventional small staplers can be unproblematically inserted.

Yet a further significant object of the present invention aims at providing a new and improved construction of an organizing device of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the organizing device of the present invention is manifested by the features that the spring means are mounted transversely to a longitudinal axis of the magazine for feeding staples sequentially arrayed in the magazine toward a head of the magazine defining the stop means.

The use of a spring stressed in bending and supported laterally of the staple magazine, or the use of a spiral spring tensioned between two anchor knobs laterally of the staple magazine, permits the full exploitation of the magazine over its entire length and also permits an extremely short construction of the stapler such as is never possible in conventional devices.

The novel design of the stapler as well as the transferral of the pivot axis of the hole punch rocker arm behind the punching plane permit uniting both devices into a single narrow device which is also smaller and lighter than known hole punches not having a stapler. Both in use exclusively as a stapler and in use in combination with the hole punch, the fixed arrangement of the magazine in the base proves to be extremely advantageous in the guidance of the insertion plunger when inserting staples. The insertion plunger guides, which are also stationary with respect to the base and extend exactly perpendicular thereto, prevent the jamming of the insertion plunger and of the staples so common in conventional staplers and thereby prevent faulty staplings. The slot-like aperture in the insertion plunger lends the latter the property of adapting itself precisely to the insertion plunger guides in the base and in the magazine and therefore the ability to insert the staples into the document precisely and without jamming. The insertion plunger also contributes considerably to jam-free insertion by being translatable transversely to the insertion direction of the staples.

In contrast to conventional staplers, in which a spiral spring must be preloaded or retracted for refilling staples and retained while inserting the staples, in the device according to the invention the staples are simply inserted into the magazine cassette and inserted therewith. If a magnet is inserted in the head of the magazine, the staples will adhere to it. By sliding a latch provided on the rocking lever of the hole punch, the user can determine whether the punching operation is to be performed jointly with the stapling operation or only one of the two functions is to occur. If a magazine having a latching spring is employed, the magazine is automatically latched when inserted into the cassette opening.

A further advantage consists in that by jointly punching and stapling the documents, they are united with exactly aligned holes which significantly facilitates leafing through a ring binder and also subjects the holes to less loading. Inserting the staples between the punched holes further facilitates leafing through such punched documents and reduces the danger of tearing out the staples. The device can also be used in conventional manner, either for hole-punching only or for stapling only.

The small external dimensions made possible by the novel arrangement of the magazine permit accommodating this device within a ring binder only 4 cm wide without sacrificing document space. A further advantage consists in that the fabrication cost of such an organizing device comprising a hole punch and a stapler is hardly higher than the cost of either of the devices individually.

By renouncing a long lever, i.e. a long rocker arm, a shorter stroke and a high cutting speed of the punches is obtained. The small dimensions of the stapler as well as of the entire organizing device permit the latter to be taken on trips.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 shows a perspective view of the organizing device;

FIG. 2 shows a side view of the organizing device in the direction of the arrow A;

FIG. 3 shows a cross-section through the organizing device in the region of the stapler and along the line III—III in FIG. 4;

FIG. 4 shows a section along line IV—IV in FIG. 3;

FIG. 5 shows a perspective view of the staple magazine;

DETAILED DESCRIPTION OF THE PREFERRED EMBODIMENTS

Figure 6:
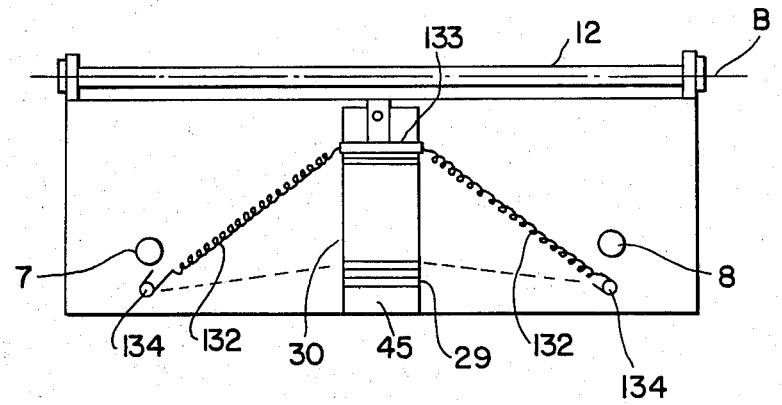
FIG. 6 shows a section along line IV—IV in FIG. 3.

Describing now the drawings, it is to be understood that to simplify the showing thereof only enough of the structure of the organizing device has been illustrated therein as is needed to enable one skilled in the art to readily understand the underlying principles and concepts of this invention.

Turning now specifically to FIG. 1 of the drawings, the organizing device illustrated therein by way of example and not limitation will be seen to comprise a hole punch in a position of operational readiness. A slot 3 open toward the front for accommodating the edge of one or more documents is provided in the base 2. A void 4 extending along and situated beneath the slot 3 can be laterally closed by suitable covers not particularly shown. Guide bores for accommodating paper punches 7 and 8 are provided in the base portion 6 in spaced relationship (for instance, 8 cm=ring spacing in a typical binder). The paper punches 7 and 8 are made of steel and comprise conventionally hollow-ground edges at their lower ends. The paper punches 7 and 8 are held in a raised position by a spring 9 and are prevented from sliding out of the base portion 6 by this spring 9.

The spring 9 is situated fully within a void 10 in the base portion 6. The void 10 can be closed at the top by a covering member 11 attached to the base portion 6 or by a removable, e.g. screwed, cover.

A pivot shaft 12, whose axis B extends parallel to the rear edge of the base portion 6 is provided at the rear on the base 2. A rocking lever 13 is pivotably mounted on the pivot shaft 12 and comprises an opening 16 between the two pivot points 14 and 15. A further rocking lever 17 is pivotably fastened upon the pivot shaft 12 in the region of this opening 16. The lateral legs 18 and 19 of the rocking lever 13 bear freely upon the upper ends of the paper punches 7 and 8. A component 20 preferably made of spring steel is mounted on the rocking lever 17. A guide pin 21 fixedly connected to the rocking lever 17 engages a slot 23 provided in a center portion 22 of the component 20. The center portion 22 can be inserted in a groove 24 provided on the underside of the rocking lever 17 as a supplementary longitudinal guide for the component 20. The rear leg 25 of the component 20 wraps around the pivot shaft 12 and rests freely with its bent end 26 upon the base portion 6. The forward leg engages a slot-like aperture 28 in the base portion 6 and serves as an insertion plunger 27 for U-shaped staples 29 situated in a magazine 30.

The magazine 30 is inserted in the base portion 6 as a cassette which is retained in the base portion 6 by sliding latches 31 at the front and is bounded at the rear by a spring 32 (FIGS. 3, 4 and 5). When the staple magazine 30 is full, the spring 32 is situated in the position shown in solid line in FIG. 4; when the magazine 30 is nearly empty, the spring 32 has the shape represented in broken line. The spring force F acting on the staples 29 remains substantially constant over the entire length of the magazine.

In order to obtain this constant spring force F, the spring 32 is provided with a special shape: between the two paper punches 7 and 8 or between two other correspondingly formed pivot points, there lies—according to the section shown in FIG. 4—a central portion 33 bent, according to the orientation of FIG. 4, downwardly in the unloaded state of the magazine 30 and upwardly in the loaded state. Beyond the paper punches 7 and 8 there are S-shaped end portions 34. The outer loops 35 wrap around the paper punches 7 and 8 and bear against the stop members 11, which maintains the spring 32 under stress at all times.

In place of the spring 32 stressed in bending as just described, a spiral or coil spring 132 can also be employed (FIG. 6). The spring 132 is attached at its ends to two anchor pins 134 and maintained under tension. Both anchor pins 134 are preferably located ahead of the two paper punches 8 and 7, i.e. closer to the front side of the device, in order that the last staple 29 situated in the staple magazine 30 also can be pressed against the head 45 of the magazine 30 beneath the aperture 28. The spring 132 can run through a sleeve 133 in its central region; it can also consist of two components which are united by the sleeve 133.

When refilling the magazine, respectively the cassette, with staples 29, the spring 32 which is bent downward in the orientation of FIG. 4, that is toward the aperture, is moved upward, that is to the rear. The central portion 33 of the spring 32 lying between the two paper punches 7 and 8 and serving as stop means bends or deforms and the S-shaped end portions 34 are partially pressed together and in addition pivot outwardly. The increased path length of the central portion 33 due to the deformation is compensated by a corresponding excess length of this component (cf. FIG. 4, broken line) extending beyond the paper punches 7 and 8. When using a spiral or coil spring 132, the latter is pressed to the rear when refilling the magazine 130 and is thereby tensioned.

With this arrangement of spring, the magazine 30 can be filled over its entire length with staples 29. The cassette can be provided with lateral slits 36 for precise guidance of the spring 32. The head 45 of the cassette 30 serves both for the longitudinal guidance of the staples and of the insertion plunger 27 when stapling. A tongue-shaped protrusion 46 on the head 45 engages an aperture 47 on the insertion plunger 27 and retains the latter in the aperture 28 in the base portion 6. Without the protrusion 46, the insertion plunger 27 would slide out of the aperture 28 due to the tension in the spring 32. The slot-shaped aperture 47 renders the insertion plunger 27 elastic without reducing the stability necessary for inserting the staples. A mark 37 is provided on the front side of the base portion 6 to indicate the middle of the punch spacing; a scale 38 can be provided on the base portion 5. A letter opener or a knife 39 can be inserted underneath the pivot shaft 12.

The two holes 40 and 41 for the paper punches 7 and 8 can be constructed as inserts and inserted into suitable depressions in the base 5 not particularly illustrated. The same is also true for the closure plate 43. This provides the possibility of fabricating these heavily loaded components from a wear-resistant material.

The operation of the device 1 is as follows: When the rocking lever 13 is depressed, the two paper punches 7 and 8 are translated against the force of the spring 9 through the slot 3 into the bores 40 and 41 arranged concentrically to the paper punches 7 and 8 and serving as female die members. If there is a document in the slot 3, then two holes will be punched out of it. The punched-out punchings 42 fall through the bores 40 and 41 into a void 4 serving as a storage container. They can be taken from this void 4, respectively emptied therefrom, by removing the lateral covers. The spring 9 is designed such that the two paper punches 7 and 8 return into the raised initial position by overcoming friction in the holes in the document after the rocking lever 13 has been released.

When the rocking lever 17 is depressed, the insertion plunger 27 slides through the aperture 28 and is guided downwardly and presses the foremost staple 29 through the document lying in the slot 3. The ends of the U-shaped staples 29 are deformed and closed in known manner upon a closure plate or forming anvil 43 provided in the base portion 5.

The insertion plunger 27 can move downwardly over the entire insertion path in an absolutely perpendicular orientation, i.e. precisely in the insertion direction of the staples 29, since the entire component 20 can slide forward along the groove 24 in the rocking lever 17 during the depression of the rocking lever 17. In other words: both the insertion plunger 27 and the staples 29 accommodated in the magazine 30 which is in stationary relationship to the closure plate 43 and to the document do not follow the usual arc-shaped path of conventional staplers when the rocking lever 17 is depressed, but always slide in relation to the document in a constant plane perpendicular to the document.

If several documents are to be conjointly hole-punched and stapled, both rocking levers 13 and 17 are conjointly pressed, e.g. downwardly with the ball of the hand. The stapling and hole-punching occur simultaneously. The documents are united with precisely aligned holes.

Of course, the two rocking levers 13 and 17 can be coupled together in various manners: if they are fixedly connected together, the stapling and hole-punching occur conjointly; if the rocking lever 17 overlaps the rocking lever 13, then punching can occur independently of the stapler or both functions can be executed simultaneously; if the rocking lever 13 overlaps the rocking lever 17, then the stapling can occur independently of hole-punching but holes can only be punched conjointly with a stapling operation.

It is also readily possible to couple the two rocking levers 13 and 17 together as required by means of a sliding latch 44 mounted on one of the rocking levers 13 or 17. The sliding latch 44 is slid either over or under or into a slot in the rocking lever 13. This measure permits the above-described functions to be optionally selected.

In the embodiment according to FIG. 7, the device again comprises a base 2 with a paper slot 3, two paper punches 7 and 8 guided in the upper base portion 6 and maintained in a raised position by a spring 9, the rocking lever 13 for depression of the paper punches 7 and 8 and the pivot shaft 12 upon which the rocking lever 13 is pivotably hinged. The springs 32 and 132 for feeding or advancing the staples 29 are also arranged analogous to the previously described embodiment.

A pin 150 is arranged in the middle of the upper base portion 6 as a holding or locating means for a latching element 144. The latching element 144 consists substantially of two leg members 151 and 152 disposed at an angle to one another. A hole 135 is provided in the lower leg 151 for engaging the knob or pin 150. The latch leg 152 is completed by a hook-shaped end piece, the latch 153. A spiral spring 120 is inserted between the latching element 144 and the rocking lever 117. In order that the spring 120 be laterally guided, a cylindrical knob 121 protrudes from the lower side of the rocking lever 117. The insertion plunger 127 bears in slit-shaped guides 154 at both sides of the rocking lever 117 by a pin 155 guiding the insertion plunger 127. A tongue-shaped nose 156 protrudes beyond the forward end of the rocking lever 117. A slit-shaped opening 157 is provided in the upper side of the rocking lever 117 for the latch 153 and through which the latch 153 extends (cf. FIG. 8).

In an initial state of the organizing device, the front edge of the hook-shaped end piece constituting the latch 153 abuts and forcibly bears against the front edge of the slit-shaped opening 157 due to the action of the coil spring 120 pressing down on the lower leg member 151 and tending to pivot the latching element 144 conjointly with the latch 153 in a forward direction about the lower edge of the latch leg 152. When the second rocking lever 117 is depressed, either independently or by being entrained by the first rocking lever 13 through the tongue-shaped nose 156, the front edge of the slit-shaped opening 157 descends in relation to the front edge of the latch element 153 and permits the latch 153 to pivot forwardly and engage over the second rocking lever 117. As the second rocking lever 117 is further depressed, it causes the flat insertion plunger 127 to push a staple 29 down through the aperture 28, through the documents to be stapled and against the closure plate or forming anvil 43.

When the second rocking lever 117 is then released, the coil spring 120 causes it to return toward the above-mentioned initial position and to effect an initial retraction of the flat insertion plunger 127 from the aperture 28. However, the latch 153 now having engaged over the front edge of the slit-shaped opening 157 arrests the second rocking lever 117 in a partially depressed state and therefore prevents the flat insertion plunger 127 from being fully retracted from the aperture 28. Since the flat insertion plunger 127 is not fully retracted, a further staple 29 cannot be advanced by the spring member 32 or 132 for the next insertion. Therefore, any further depressions of the second rocking lever 117 from this intermediate position will actuate the flat insertion plunger 127 without inserting a staple 29.

In order to effect further insertions of staples 29, it is necessary to manually pivot the latch 153 rearwardly to disengage the front edge of the slit-shaped opening 157 of the second rocking lever 117 and thereby allow the second rocking lever 117 to fully return to its initial or activated position. This returns the flat insertion plunger 127 to a retracted position which permits a further staple 29 to be advanced into the insertion aperture 28 ready for the next insertion. If the second rocking lever 117 is now depressed again, a further staple 29 will be inserted and the latch 153 will again engage the second rocking lever 117 and prevent it from returning fully to its initial or activated position and thereby inhibit further insertion of staples 29.

Thus, to insert a staple alone, it is always necessary to pivot the latch 153 rearwardly and allow the second rocking lever 117 to rise to its uppermost, initial or activated position. The first subsequent depression of the second rocking lever 117 will then insert a staple.

In order to conjointly insert a staple 29 and punch two holes, it is still always necessary to pivot the latch 153 rearwardly and permit the second rocking lever 117 to rise to its uppermost, initial or activated position. The first subsequent depression of the first rocking lever 13 will cause holes to be punched and will also entrain the second rocking lever 117 downwardly through the tongue-shaped nose 156 to insert a staple.

To punch two holes alone, it is only necessary to depress the first rocking lever 13 without having rearwardly pivoted the latch 153. Since the second rocking lever 117 has not been allowed to return to its uppermost position, no new staple 29 has been advanced for insertion by the flat insertion plunger 127 and no stapling action occurs. Should the second rocking lever 117 have already been returned to its uppermost position, whether intentionally or inadvertently, for instance by pivoting the latch 153 rearwardly, a stapling action must ineluctably be performed, perhaps on a blank sheet of paper or on the empty plate or forming anvil 43. This will cause the latch 153 to re-engage the second rocking lever 117 and restrain it in the semi-depressed position.

Figure 8:
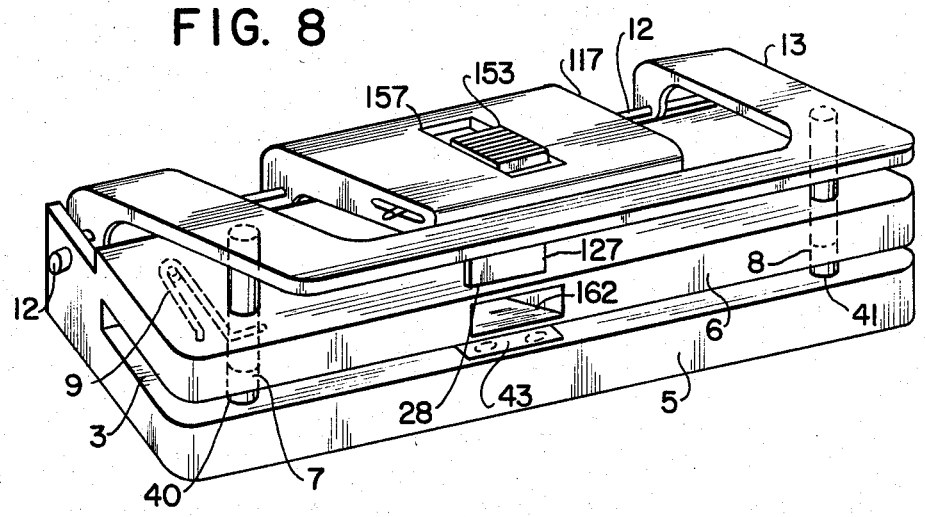
FIG. 8 shows a perspective view of the assembled organizing device.
Figure 7:
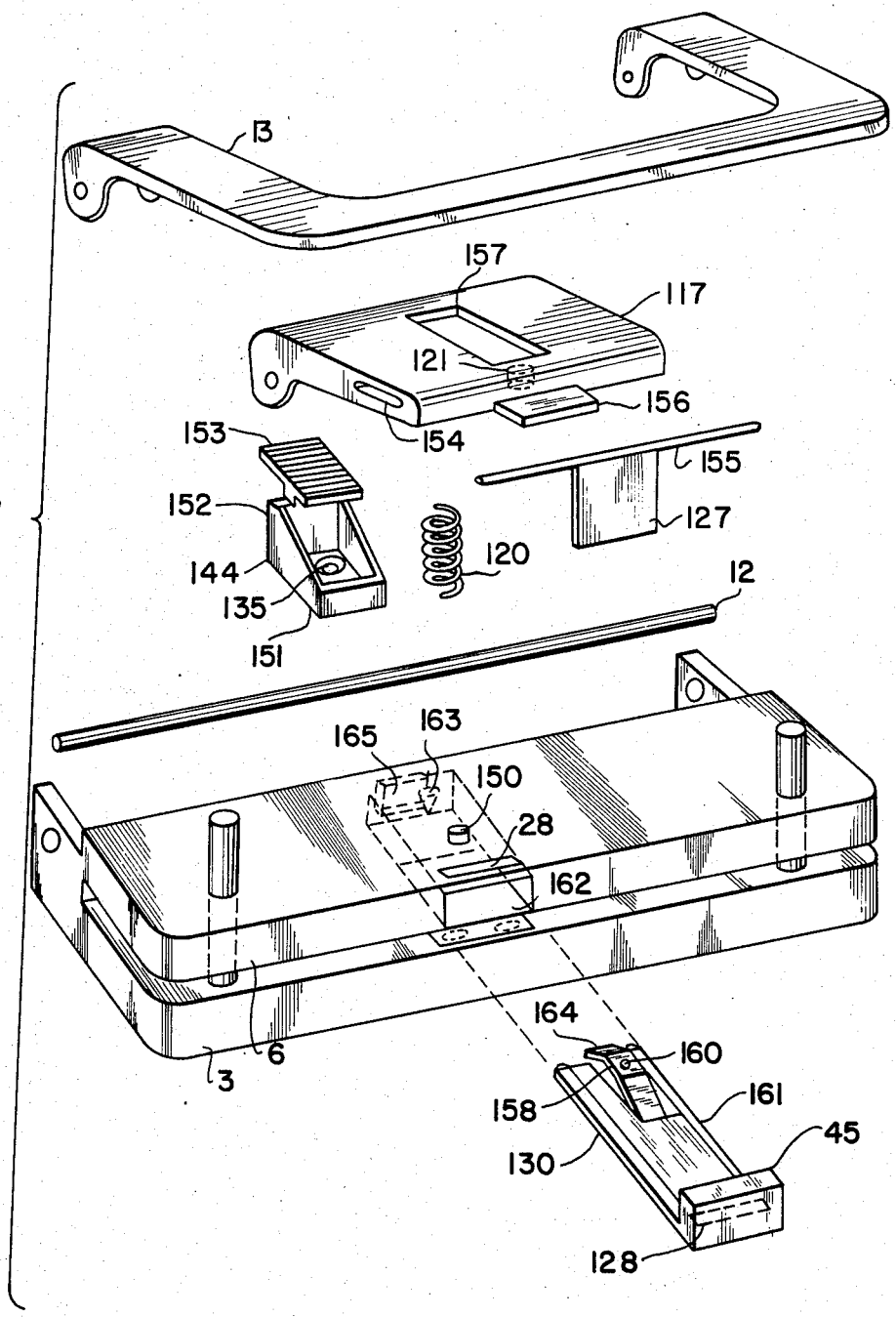
FIG. 7 shows a perspective view of the organizing device disassembled.

In place of the latch 31 provided in the FIGS. 1 through 3 for retaining the magazine 30 in the base portion 6, in the embodiment according to FIGS. 7 and 8 the magazine 130 is provided with an arresting spring 158 having an arresting hole 160. The remainder of the magazine 130 comprises a sheet metal shape 161 accommodating the staples 29 which is completed by a head portion 45 upon the side having the aperture, respectively the slot 128 for the staples 29. The arresting spring 158 can be a bent-up portion of the sheet metal shape 161, as is shown in FIG. 7, but it can also be welded or riveted upon the sheet metal shape 161.

In the rear portion of the base 6, i.e. opposite an insertion aperture 162 for the magazine 130, a fine pin 163 protrudes into the insertion region of the magazine 130 and, when the latter is completely inserted, hooks into the hole 160 of the arresting spring 158. The end 164 of the spring 158 is angled slightly downward and extends into an aperture 165 provided on the rear side of the base portion 6. Both the rocking lever 117 for performing the stapling and the rocking lever 13 for depressing the paper punches 7 and 8, are, as in the first embodiment, preferably hinged upon a common pivot shaft 12 at the rear side of the base 2.

In the embodiment of the device according to FIGS. 1 through 8, the magazine 30 bears with its lower side upon the base portion 6 over its entire length. When employing a magazine 130 having the arresting spring 158, the base portion 6 can also be designed such that the magazine 130 bears with its lower side upon the base portion 6 only in the rear region; at the front, i.e. the forward end of the magazine, it can however pivot slightly downward to the documents inserted in the slot 3 when the rocking lever 117 is depressed.

As in the embodiment according to FIGS. 1 through 6, in the device according to FIGS. 7 and 8 the paper punches 7 and 8 are pressed through the documents when the rocking lever 13 is depressed. As soon as the rocking lever 13 engages the tongue-shaped nose 156 of the rocking lever 117, the rocking lever 117 together with the insertion plunger 127 are simultaneously pivoted downward by the rocking lever 13. A staple 29 is, however, only inserted when the latch 153 has previously been pivoted rearwardly and the rocking lever 117 has been pivoted upward by the spring 120. During the upward pivoting motion, the insertion plunger 127 still lying clamped between the foremost staple 29 and the head piece 45 following the preceding stapling operation also slides upwardly and a new staple 29 can advance in order to be inserted into the documents.

When inserting a staple 29, whether it be inserted conjointly with a hole-punching operation or by pressing the rocking lever 13 alone, the element 144 comprising the latch 153 pivots forwardly and the latch 153 hooks into the hole 157 of the rocking lever 117. The rocking lever 117 can therefore only partially pivot upwardly. In this manner, the insertion plunger 127 prevents a new staple 29 from advancing. Upon the next operation of the hole-punching rocking lever 13 no simultaneous stapling therefore occurs, since the insertion plunger 127 slides downwardly between the head piece 45 and the foremost staple 29. If the magazine 130 is pivotably constructed, then it can follow the pivoting motion of the rocking lever 117 until it engages the documents lying in the slot 3.

To refill the magazine 130 with staples 29, the end 164 of the arresting spring 158 is pressed downwardly with a fingernail and therefore out of the engagement region of the pin 163. Due to the force of the spring 32, respectively 132, acting upon the magazine 130, the latter slides out of the base 6. After filling a new load of staples, the magazine 130 is slid back into the insertion opening and is automatically arrested or retained by the pin 163. Of course, the arresting spring 158 can also be released by means of a suitable system of levers not particularly illustrated.

A textile hook and loop fastening can be adhered to the underside of the base portion 5 (not visible) by means of which the device can be releasably fastened in any desired suitable location, for instance in the back of a ring binder. The hook and loop fastener also serves as a soft cushion as well as as a brush for wiping eraser crumbs from the writing surface.

Instead of a void 4 integrated into the base portion 5 for accommodating punched-out paper punchings, a cover plate member made of soft plastic and known per se can be attached to the base portion 5 from beneath.

The organizing device 1 is preferably fabricated in injection molding from aluminum, die-cast zinc or plastic. If the plastic is suitably chosen, the rocking levers 13 and 17 together with the base 2 can be fabricated in a single piece, thereby obviating the need of mounting a pivot shaft 12. The spring component 20 is fixedly connected with the rocking lever 17 in this embodiment.

Of course, the device 1 according to the invention may also comprise staplers of the same design located laterally beyond the paper punches 7 and 8 if a somewhat greater length is accepted, should the stapling for any reason be precluded from lying between the holes. If a magnet is employed in the head portion 45 of the magazine 30, respectively 130, the staples 29 will adhere to the magnet.

While there are shown and described present preferred embodiments of the invention, it is to be distinctly understood that the invention is not limited thereto, but may be otherwise variously embodied and practiced within the scope of the following claims.

Accordingly, what we claim is:

1. In an organizing device for travel, office, school and the home, comprising a hole punch having a first rocking lever and at least two punches, a stapler integrated into said hole punch for stapling together documents being processed by means of an initially U-shaped staple and having a magazine for accommodating a plurality of said initially U-shaped staples and including stop means for said plurality of initially U-shaped staples, spring means for pressing said plurality of initially U-shaped staples against said stop means in said magazine, a substantially flat insertion plunger for inserting a staple of said plurality of initially U-shaped staples and bearing against the stop means into the documents being processed and a second rocking lever operatively connected with said substantially flat insertion plunger, a base pivotably connected to said first and second rocking levers and having a forming anvil for closing the legs of said staple upon a rear side of the documents being processed and at least two bores defining female die members for said punches of said hole punch, the improvement which comprises:

said magazine having a longitudinal axis and a head defining said stop means;

spring means mounted transversely to said longitudinal axis of said magazine for feeding said plurality of initially U-shaped staples sequentially arrayed in said magazine toward said head; and said substantially flat insertion plunger being provided with a slot-shaped aperture extending along said substantially flat insertion plunger for increasing the bending elasticity thereof.

2. In an organizing device for travel, office, school and the home, comprising a hole punch having a first rocking lever and at least two punches, a stapler integrated into said hole punch for stapling together documents being processed by means of an initially U-shaped staple of conventional design and having a magazine for accommodating a plurality of said initially U-shaped staples and including stop means for said plurality of initially U-shaped staples, spring means for pressing the plurality of initially U-shaped staples against said stop means in said magazine, a substantially flat insertion plunger for inserting a staple of said plurality of initially U-shaped staples and bearing against the stop means into the documents being processed and a second rocking lever operatively connected with said substantially flat insertion plunger, a base pivotably connected to said first and second rocking levers and having a forming anvil for closing the legs of said staple upon a rear side of the documents being processed and at least two bores defining female die members for said punches of said hole punch, the improvement which comprises:

said magazine having a longitudinal axis and a head defining said stop means;

said spring means being mounted transversely to said longitudinal axis of said magazine for feeding said plurality of initially U-shaped staples sequentially arrayed in said magazine toward said head;

anchor pins mounted laterally of said magazine; and a spiral spring defining said spring means being loadable in tension and engaging at said anchor pins for advancing said plurality of initially U-shaped staples toward said head defining said stop means in said magazine.

3. The improvement as defined in claim 2, wherein:

said spiral spring is divided into two sections and comprises a rigid intermediate central member which engages a rearmost staple of said plurality of initially U-shaped staples in said magazine.

4. In an organizing device for travel, office, school and the home, comprising a hole punch having a first rocking lever and at least two punches, a stapler integrated into said hole punch for stapling together documents being processed by means of an initially U-shaped staple and having a magazine for accommodating a plurality of said initially U-shaped staples and including stop means for said plurality of initially U-shaped staples, spring means for pressing said plurality of initially U-shaped staples against said stop means in said magazine, a substantially flat insertion plunger for inserting a staple of said plurality of initially U-shaped staples and bearing against the stop means into the documents being processed and a second rocking lever operatively connected with said substantially flat insertion plunger, a base pivotably connected to said first and second rocking levers and having a forming anvil for closing the legs of said staple upon a rear side of the documents being processed and at least two bores defining female die members for said punches of said hole punch, the improvement which comprises:

said magazine having a longitudinal axis and a head defining said stop means;

spring means mounted transversely to said longitudinal axis of said magazine for feeding said plurality of initially U-shaped staples sequentially arrayed in said magazine toward said head;

said substantially flat insertion plunger comprising a spring steel component;

an upper component defined by said spring steel component being longitudinally translatably guided upon said second rocking lever;

said substantially flat insertion plunger having a rear leg defined by said spring steel component;

said substantially flat insertion plunger having a bent end defined by said spring steel component; and said upper component and said rear leg and said bent end of said substantially flat insertion plunger defined by said spring steel component being constructed as spring elements for retaining said second rocking lever and said substantially flat insertion plunger in a raised position.

5. The improvement as defined in claim 4, further including:

a pivot shaft for pivotably mounting said second rocking lever;

said upper component, said rear leg and said bent end of said substantially flat insertion plunger wrapping around said pivot shaft; and said bent end being supported on said base.

6. The improvement as defined in claim 5, further including:

said pivot shaft having a pivot axis; and said first and second rocking levers both being pivotable about said pivot axis.

7. In an organizing device for travel, office, school and the home, comprising a hole punch having a first rocking lever and at least two punches, a stapler integrated into said hole punch for stapling together documents being processed by means of an initially U-shaped staple and having a magazine for accommodating a plurality of said initially U-shaped staples and including stop means for said plurality of initially U-shaped staples, spring means for pressing said plurality of initially U-shaped staples against said stop means in said magazine, a substantially flat insertion plunger for inserting a staple of said plurality of initially U-shaped staples and bearing against the stop means into the documents being processed and a second rocking lever operatively connected with said substantially flat insertion plunger, a base pivotably connected to said first and second rocking levers and having a forming anvil for closing the legs of said staple upon a rear side of the documents being processed and at least two bores defining female die members for said punches of said hole punch, the improvement which comprises:

said magazine having a longitudinal axis and a head defining said stop means;

spring means mounted transversely to said longitudinal axis of said magazine for feeding said plurality of initially U-shaped staples sequentially arrayed in said magazine toward said head;

said base being provided with an insertion aperture;

an arresting spring having a rearward end bent up in ramp-like fashion and an arresting aperture; and said magazine being constructed as a cassette which is insertable into said insertion aperture in said base and comprising said arresting spring.

8. The improvement as defined in claim 7, further including:

a pin capable of hooking into said arresting aperture and which is inserted into said base at a rear end of said insertion aperture.

9. The improvement as defined in claim 7, wherein:

said insertion aperture is provided in a front side of said base; and said magazine constructed as a cassette being insertable into said insertion aperture from said front side.

10. In an organizing device for travel, office, school and the home, comprising a hold punch having a first rocking lever and at least two punches, a stapler integrated into said hole punch for stapling together documents being processed by means of an initially U-shaped staple and having a magazine for accommodating a plurality of said initially U-shaped staples and including stop means for said plurality of initially U-shaped staples, spring means for pressing said plurality of initially U-shaped staples against said stop means in said magazine, a substantially flat insertion plunger for inserting a staple of said plurality of initially U-shaped staples and bearing against the stop means into the documents being processed and a second rocking lever operatively connected with said substantially flat insertion plunger, a base pivotably connected to said first and second rocking levers and having a forming anvil for closing the legs of said staple upon a rear side of the documents being processed and at least two bores defining female die members for said punches of said hole punch, the improvement which comprises:

said magazine having a longitudinal axis and a head defining said stop means;

spring means mounted transversely to said longitudinal axis of said magazine for feeding said plurality of initially U-shaped staples sequentially arrayed in said magazine toward said head;

said magazine of said stapler being arranged in a base portion rigidly connected to said base and forming conjointly with said base a slot for accommodating documents; and said substantially flat insertion plunger being translatably mounted transversely to an insertion direction of said plurality of initially U-shaped staples for precisely vertically guiding said substantially flat insertion plunger during the insertion of each said staple of said plurality of initially U-shaped staples into the documents.

11. The improvement as defined in claim 10, wherein:

said base portion has an aperture; and said magazine is insertable into said aperture in said base portion.

12. The improvement as defined in claim 10, further including:

a slot-shaped guide extending substantially transverse to a feed direction of said plurality of initially U-shaped staples in said base for translatably guiding said substantially flat insertion plunger; and said substantially flat insertion plunger always lying in a plane of a foremost staple of said plurality of initially U-shaped staples independently of the momentary position of said second rocking lever.

13. The improvement as defined in claim 10, further including:

spring stop means arranged laterally of said magazine; and said spring means comprising a wire-like, arc-shaped spring portion loadable in bending and supported at said spring stop means for advancing said plurality of initially U-shaped staples against said head defining said stop means in said magazine.

14. The improvement as defined in claim 10, further including:

sliding latch members arranged on said base portion; and said magazine being constructed as a cassette and being retained in said base portion by said sliding latch members.

15. The improvement as defined in claim 10, wherein:

the device is capable of being inserted into a back of a ring binder.

16. The improvement as defined in claim 10, further including:

a magnet inserted into said head of said magazine.

17. The improvement as defined in claim 10, further including:

a spiral spring inserted between said second rocking lever and said base portion and by means of which said second rocking lever and said substantially flat insertion plunger mounted thereupon are returnable to an initial position thereof after depression for inserting a staple of said plurality of initially U-shaped staples.

18. The improvement as defined in claim 17, further including:

a pivotable latching element capable of engaging said second rocking lever and inserted between said spiral spring and said base portion for retaining said second rocking lever in a semi-raised position.

19. The improvement as defined in claim 18, wherein:

said pivotable latching element comprises a base leg accommodating an end of said spiral spring and a latching leg arranged substantially perpendicular to said base leg; and said latching leg being provided with a hook-shaped latch.

20. The improvement as defined in claim 19, wherein:

said second rocking lever is provided with an aperture for engaging said hook-shaped latch.

* * * * *